US009063522B2

(12) United States Patent
Ferri et al.

(10) Patent No.: US 9,063,522 B2
(45) Date of Patent: Jun. 23, 2015

(54) DEVICE FOR SECURING A CELL BATTERY WITH IMPROVED CONTACT

(71) Applicant: ETA SA Manufacture Horlogere Suisse, Grenchen (CH)

(72) Inventors: Yvan Ferri, Lausanne (CH); Stephane Rychen, Bern (CH); Roger Willemin, Grenchen (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 188 days.

(21) Appl. No.: 13/835,955

(22) Filed: Mar. 15, 2013

(65) Prior Publication Data

US 2013/0272101 A1 Oct. 17, 2013

(30) Foreign Application Priority Data

Apr. 13, 2012 (EP) ..... 12164124

(51) Int. Cl.
*G04C 10/00* (2006.01)
*G04G 17/06* (2006.01)

(52) U.S. Cl.
CPC ..... *G04G 17/06* (2013.01); *G04C 10/00* (2013.01)

(58) Field of Classification Search
CPC ..... G04C 10/00; G04G 17/06
USPC ..... 368/88, 203, 204, 281; 307/66; 429/98
See application file for complete search history.

(56) References Cited

U.S. PATENT DOCUMENTS 3,911,663 A * 10/1975 Kern et al. ..... 368/204
4,202,166 A * 5/1980 Komiyama et al. ..... 368/82
4,435,088 A * 3/1984 Dorfman ..... 368/88
4,477,195 A * 10/1984 Saitoh et al. ..... 368/88
4,478,524 A * 10/1984 Saitoh et al. ..... 368/204
4,638,409 A * 1/1987 Berman ..... 362/104
4,763,308 A * 8/1988 Morata ..... 368/88
5,055,704 A * 10/1991 Link et al. ..... 307/66
5,289,034 A * 2/1994 Hundt ..... 257/678
6,381,199 B1 4/2002 Kröner et al.
2002/0167868 A1 11/2002 Murai

FOREIGN PATENT DOCUMENTS

EP 1 256 856 A2 11/2002
EP 1 256 856 A3 11/2002
FR 1.467.190 1/1967

OTHER PUBLICATIONS

European Search Report issued Jul. 11, 2012, in Patent Application No. EP 12 16 4124, filed Apr. 13, 2012 (With English Translation of Category of Cited Documents).

* cited by examiner

*Primary Examiner* — Vit W Miska
(74) *Attorney, Agent, or Firm* — Oblon, McClelland, Maier & Neustadt, L.L.P.

(57) ABSTRACT

A structure for a timepiece includes a middle part and a back cover that confines an electronic or electrical module. The module includes a plate, at least one circuit with at least one electrical contact area, and a connecting contactor. The plate includes a compartment that is arranged to receive an electrical energy accumulator. The connecting contactor provides an electrical connection between the accumulator and the at least one contact area. The contactor is rigid and includes an elastic return that tends to return the contactor to a rest geometry. The contactor includes at least a first arm and at least a second arm that together form a clamp that presses the circuit and the accumulator towards each other.

10 Claims, 2 Drawing Sheets

DEVICE FOR SECURING A CELL BATTERY WITH IMPROVED CONTACT

This application claims priority from European Patent Application No. 12164124.5 filed Apr. 13, 2012, the entire disclosure of which is incorporated herein by reference.

FIELD OF THE INVENTION

The invention concerns a timepiece structure comprising at least a middle part and a back cover for confining an electronic or electric module which in turn comprises a plate, a compartment of which is arranged to receive an electrical energy accumulator, said module further comprising at least one circuit with at least one electrical contact area, and a connecting contactor providing an electrical connection between one said accumulator and said at least one contact area, said contactor being rigid and comprising an elastic return means tending to return said contactor to a rest geometry.

The invention also concerns a timepiece comprising at least one structure of this type.

The invention concerns the field of horology, and in particular the field of watches comprising at least one electronic or electric circuit powered by an accumulator such as a cell battery or similar. The invention more specifically concerns the mechanical and electrical connection between an accumulator and a circuit, on both sides of a bottom plate.

BACKGROUND OF THE INVENTION

The quality of the electric contacts in a watch must be permanently ensured, in any configuration of use, and particularly during acceleration or a shock. More particularly, the permanence of the electric power supply from an accumulator, generally a cell battery, requires a very good connection between the poles of the accumulator and the utilisation circuit or circuits. It is known, in particular, to secure a cell battery in a housing formed by spring tongues, which hold the cell battery while ensuring contact across one of the terminals thereof. The contact at the other terminal is commonly achieved by a flexible connector, or preferably, by a lug forming a spring, secured by screws or rivets to a plate.

As regards the utilisation circuits, contacts are known which are formed by welded flexible connectors, plug-in bars, or by spring lugs pressed onto the circuit, also by screws, rivets or similar, or forming small anchor blocks clamping the circuit over the thickness of the section thereof.

To achieve a high quality permanent contact, with the smallest number of components, there is also known, for example from JP Patent No. 11-281 776 in the name of MIYOTA, a spring comprising two arms, one of which bears on a circuit and the other of which bears on a cell battery, which may be held in place by the back cover of a watch. However, the arms bear in the same direction, and the spring lug is not guaranteed to bear permanently on the circuit. This arrangement also requires a mechanical connection dedicated to the assembling of the circuit on a plate carrying the cell battery.

EP Patent Application No 1 256 856 A2 in the name of SEIKO INSTR INC discloses an electronic device with an electrical connecting tongue between a circuit and an accumulator. Said tongue includes apertures cooperating with pins fixed to the plate.

FR Patent Application No 1 467 190A in the name of RADIOTECHNIQUE COPRIM RTC discloses a circuit comprising two connecting strips, one for the positive terminal of the accumulator and the other for the negative terminal, each connected under elastic strain to a particular contact area of a circuit.

SUMMARY OF THE INVENTION

The invention proposes to ensure a permanent connection between the power supply and the utilisation circuit, by a stressed mechanism, which is not subject to interference during use. While satisfying this condition, the invention proposes to secure the circuit to the plate carrying the accumulator or the cell battery, using the minimum number of components.

The invention therefore concerns a timepiece structure comprising at least a middle part and a back cover for confining an electronic or electric module which in turn comprises a plate, a compartment of which is arranged to receive an electric energy accumulator, said module also comprising at least one circuit with at least one electric contact area, and a connecting contactor for providing an electrical connection between one said accumulator and said at least one contact area, said contactor being rigid and comprising an elastic return means tending to return the contactor to a rest geometry, characterized in that said contactor includes at least a first arm and at least a second arm together forming a clamp for pressing said circuit and said accumulator towards each other.

According to a feature of the invention, said at least one first arm and said at least one second arm together forming a clamp for pressing said circuit and said accumulator towards each other on either side of said plate, each abutting on said plate.

According to a feature of the invention, said back cover is arranged to bear, via at least a first bearing surface, on at least a first complementary bearing surface comprised in a first said arm of said contactor. Said first arm is arranged to bear, via a first electrical contact, on a said accumulator positioned in said compartment, and said back cover is also arranged to bear, via at least a second bearing surface, on at least a second complementary bearing surface comprised in said first arm of said contactor, so as to press said accumulator onto said plate.

According to a feature of the invention, said middle part is arranged to bear, via at least a third bearing surface, on at least a third complementary bearing surface comprised in a said second arm of said contactor. Said second arm is arranged to bear, via a fourth contact surface, on said at least one contact area of said circuit so as to press said circuit onto said plate.

The invention also concerns a timepiece comprising at least one structure of this type.

A single contactor forming a spring, pre-arranged in the watch on either side of the assembly comprising the circuit, the plate and the accumulator, is thus placed under strain when the back cover of the watch is positioned and closed, which, by clamping this assembly, secures the components thereof, and at the same time forms an excellent electrical contact between the accumulator and the circuit. The invention therefore does not require any additional component, screws, rivets or suchlike, and is thus particularly economical both in terms of cost and assembly time.

BRIEF DESCRIPTION OF THE DRAWINGS

Other features and advantages of the invention will appear upon reading the following detailed description, with reference to the annexed drawings, in which:

FIG. 4 is illustrated with the connecting contactor in the free state, prior to being placed under strain by closing the back cover of the watch.

DETAILED DESCRIPTION OF PREFERRED EMBODIMENTS

Figure 1:
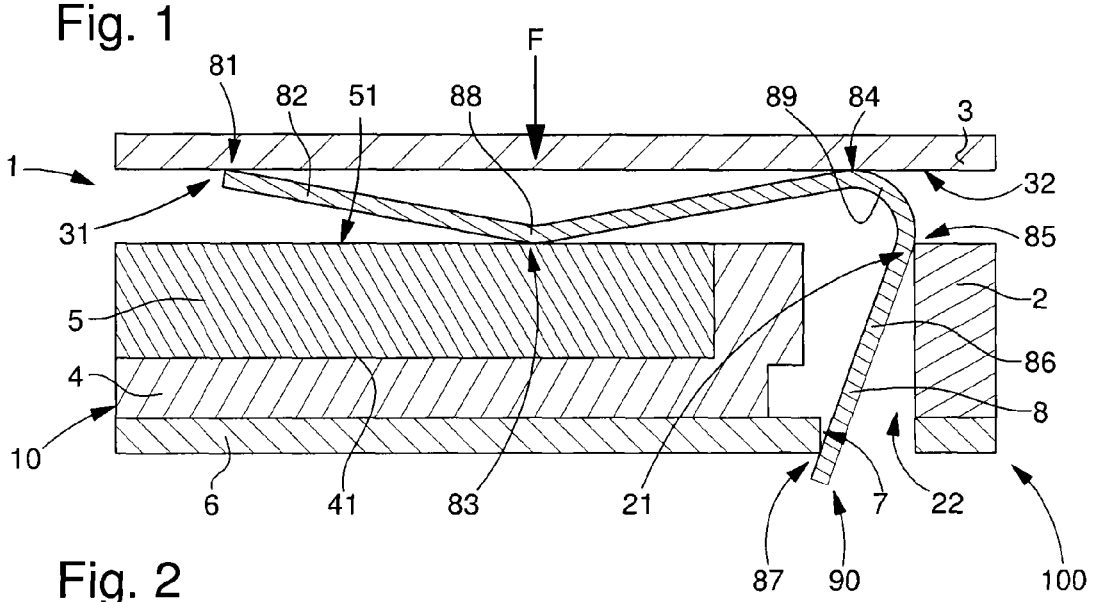
FIG. 1 shows a schematic cross-section, in a plane perpendicular to a contact surface of an accumulator, of a timepiece structure comprising a middle part and a back cover for confining a module comprising a plate, a compartment of which confines an electrical energy accumulator, said module comprising a circuit with an electric contact area, and a connecting contactor according to the invention to provide an electrical connection between the accumulator and the contact zone.
Figure 2:
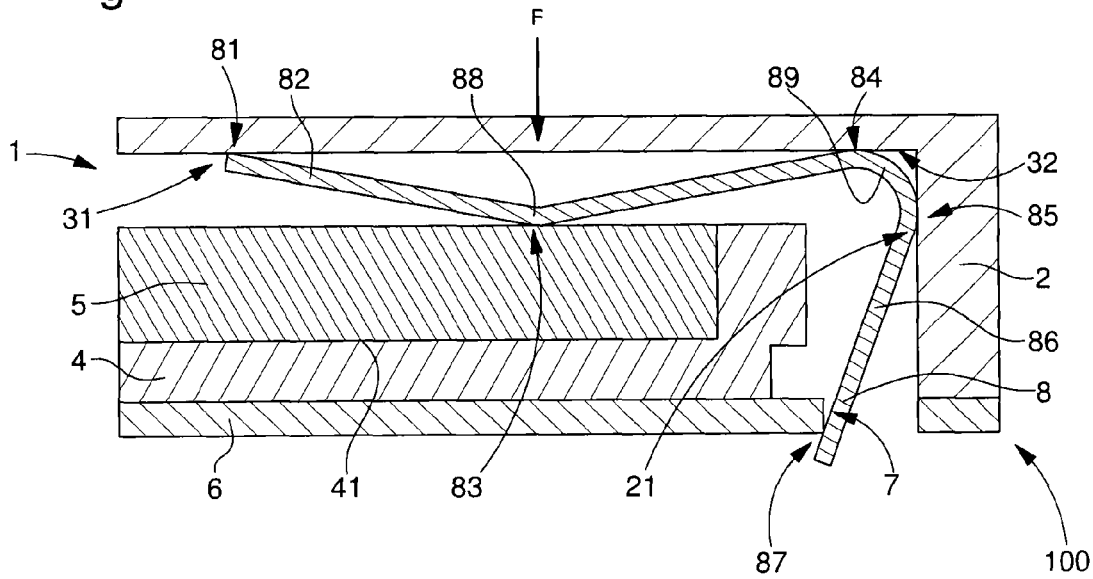
FIG. 2 shows, similarly to FIG. 1, a structure wherein the back cover and the middle part form a single-piece assembly.
Figure 8:
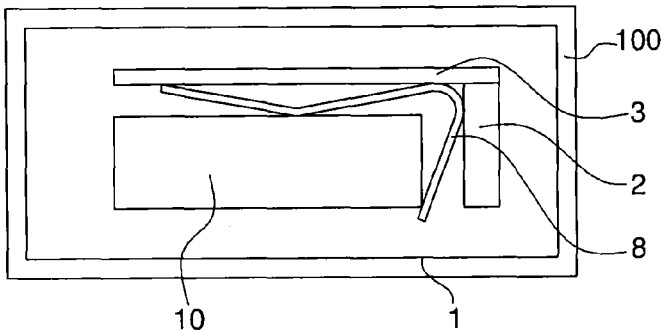
FIG. 8 shows block diagrams of a timepiece including a structure according to the invention.

The invention concerns the field of horology, and in particular the field of watches comprising at least one electronic or electric circuit powered by an accumulator such as a cell battery or similar. The invention more specifically concerns the mechanical and electrical connection between an accumulator and a circuit, on both sides of a bottom plate. In particular, in a watch this means guaranteeing the contact between the positive terminal of the cell battery and the back cover of the case in any circumstances.

The invention concerns a structure 1 of a timepiece 100, particularly a watch, comprising at least a middle part 2 and a back cover 3 for confining an electronic or electric module 10. This module 10 in turn includes a plate 4, a compartment 41 of which is arranged to receive an electrical energy accumulator 5, particularly a cell battery. This module 10 also includes at least a circuit 6 with at least one electrical contact area 7 and a connecting contactor 8 for providing an electrical connection between an accumulator 5 and a contact area 7. This contactor 8 is rigid and includes an elastic return means tending to return the contactor to a rest geometry. In a preferred but non-limiting version of the invention, the connecting contactor 8 is entirely elastic and is made in the form of a spring.

According to the invention, contactor 8 includes at least a first arm 82 and at least a second arm 86, together forming a clamp for pressing circuit 6 and accumulator 5 towards each other.

Preferably, this at least one first arm 82 and at least one second arm 86 together form a clamp for pressing circuit 6 and accumulator 5 towards each other on either side of plate 4, each abutting on said plate 4.

As shown in FIG. 1, in a preferred embodiment, back cover 3 is arranged to bear, via at least a first bearing surface 31, on at least a first complementary bearing surface 81 of a first arm 82 of contactor 8. This first arm 82 is arranged to bear, via a first electrical contact surface 83, on an accumulator 5 positioned in the compartment 2 thereof. Back cover 3 is also arranged to bear, via at least a second bearing surface 32, on at least a second complementary bearing surface 84 comprised in first arm 81 of contactor 8, so as to press accumulator 5 onto plate 4. The bearing, which is both electrical and mechanical, is achieved as a result of the particular shape of connecting contactor 8 and the effect thereof is amplified by placing contactor 8 under strain by a compressive force F exerted on back cover 3, towards accumulator 5. This compressive force is exerted each time that back cover 3 of the watch is closed, after changing the battery for example. As will be seen below, the configuration of structure 1 and that of contactor 8 are such that the user does not need to take any particular precautions during such a routine operation.

Middle part 2 is arranged to bear, via at least a third bearing surface 21, on at least a third complementary bearing surface 85 comprised in a second arm 86 of contactor 8. This second arm 86 is arranged to bear, via a fourth contact surface 87 on a contact area 7 of circuit 6, so as to press circuit 6 onto plate 4. It is owing to arched abutment of contactor 8 that it is possible to press the second arm 86 thereof efficiently onto circuit 6 and contact area 7 thereof, or contact areas 7 if there are several.

Preferably, first arm 82 forms a first elbow 88 on the first electrical contact surface 83 thereof, between first complementary bearing surface 81 and the second complementary bearing surface 84, so as to guarantee contact between the first electrical contact surface 83 and accumulator 5 when contactor 8 is pushed towards accumulator 5 under the effect of a pressure F applied to back cover 3 in the direction of accumulator 5.

The invention concerns the field of horology, and in particular the field of watches comprising at least one electronic or electric circuit powered by an accumulator such as a cell battery or similar. The invention more specifically concerns the mechanical and electrical connection between an accumulator and a circuit, on both sides of a bottom plate.

When the back cover 3 and middle part 2 are two separate components, contactor 8 preferably forms a second elbow 89 between the second complementary bearing surface 8 and the third complementary bearing surface 85. The circuit 6 is pressed against plate 4 on the opposite side relative to that of compartment 2. Contactor 8 thus forms a clamp tending to move circuit 6 closer to an accumulator 5 inserted into compartment 41, with the clamp scaffolding onto middle part 2 under the action of a compressive force F applied to back cover 3 to push said back cover towards middle part 2.

When back cover 3 and middle part 2 form one single-piece component, moveable relative to plate 4, contactor 8 also preferably forms a second elbow 89 between the second complementary bearing surface 84 and the third complementary bearing surface 85. Circuit 6 is pressed against plate 4 on the opposite side relative to that of compartment 2. Contactor 8 forms a clamp tending to move circuit 6 closer to an accumulator 5 inserted into compartment 2, the clamp scaffolding onto middle part 2 under the action of a compressive force F applied to back cover 3 to push said back cover towards plate 4.

Preferably, contactor 8 is a spring, which includes at least one transverse arm 91 and/or one flat portion 92 perpendicular to a first arm 82 and to a second arm 86 comprised in the same plane perpendicular to a contact surface 51 of accumulator 5, to prevent contactor 8 tipping as a result of a compressive force F applied to back cover 3 in the direction of accumulator 5.

Figure 3:
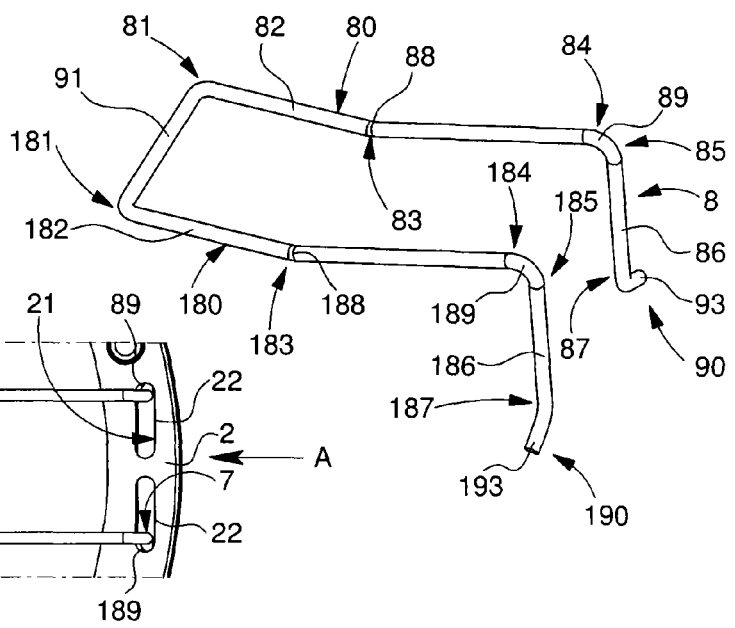
FIG. 3 shows a schematic, perspective view of a connecting contactor according to the invention, which includes two strands connected by a transverse arm, and, at the free ends of said two strands opposite the transverse arm, laterally projecting fingers.

In the embodiment of FIG. 3, spring 8 includes at least two parallel strands 80, 180 connected by at least one transverse arm 91, each strand 80, 180, comprising a free end 90, 190 with a transverse finger projecting laterally in order to make removal of spring 8 from a housing 22 in middle part 2 conditional upon the application of a force tending to move the two strands 80, 180 closer to or further away from each other. Second strand 180 includes all the areas of first strand 80, renumbered here in the format 1xx, where xx is the identifier of the corresponding area of first strand 80. In a preferred embodiment, first strand 80 and second strand 180 are strictly identical and parallel.

Figure 7:
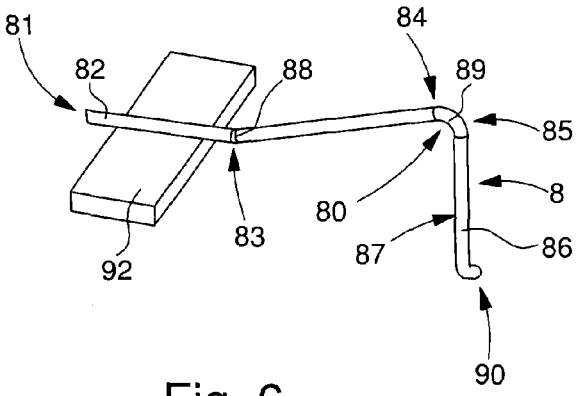
FIG. 7 shows a schematic, perspective view of a variant of the connecting contactor according to the invention, with a single strand provided with a transverse flat portion to prevent the contactor from tipping.

FIG. 7 illustrates a simplified contactor 8 with a single strand 80 provided with a transverse flat portion 92 to prevent said contactor tipping.

Figure 5:
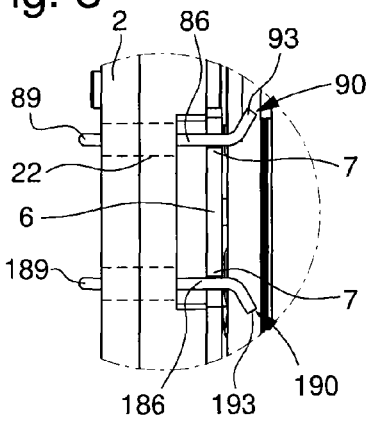
FIG. 5 is an end view in direction A of FIG. 4.
Figure 6:
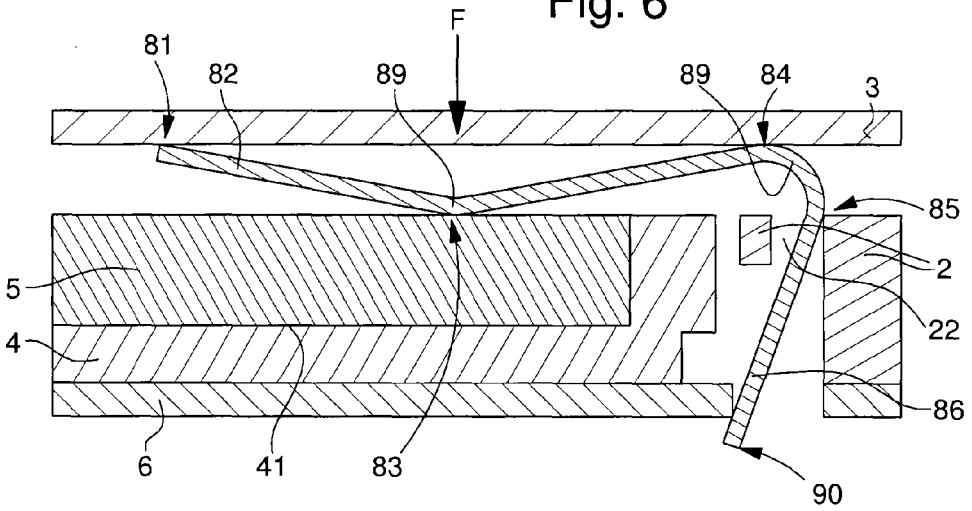
FIG. 6 is a cross-section similar to FIG. 1, of the structure of FIGS. 4 and 5, showing a second arm of the connecting contactor passing into a housing in the middle part.

FIG. 6 shows a middle part 2 with at least one housing 22 allowing a second arm 86 of connecting contactor 8 to pass through. This variant is that illustrated in FIGS. 4 and 5, and which, in the variant of FIG. 1, has the advantage of system of pre-holding contactor 8 in position. The user does not need to search for the proper position when changing the battery, since this position is imposed by the cooperation of the free ends 90 and 190 of contactor 8 with housings 22, and assembly in the best position is thus guaranteed.

Figure 4:
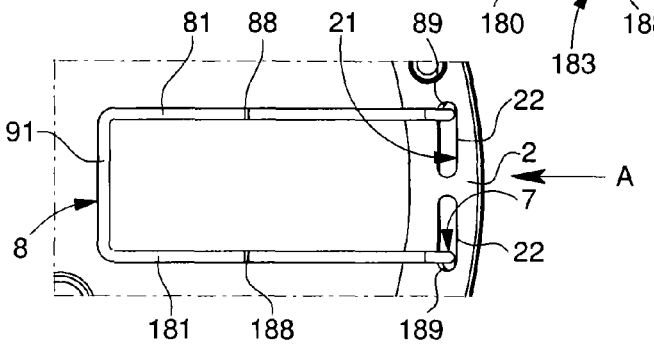
FIG. 4 shows a schematic, top view of a similar structure to that of FIG. 1, with the connecting contactor of FIG. 3, wherein the free ends of the two strands are inserted into housings in the middle part, which are arranged to allow the projecting fingers to pass through, in a transitory, lateral bending position of the contactor, shown here in a permanent position where the two strands are substantially parallel, and where the distal portion of the two strands immobilises a circuit seen underneath the housings in the middle part. This

FIG. 4 illustrates a structure 1 of this type. The free ends 90, 190 of the two strands 80, 180 are inserted into housings 22 of middle part 2, which are arranged to allow these projecting fingers to pass through, in a transitory lateral bending position of contactor 8 simply by clamping the ends of the strands thereof closer together. Contactor 8 is shown in FIG. 4 after insertion into housings 22 and after the release of the two strands 80, 180, in a permanent position where the two strands are substantially parallel, and where the distal portion of these two strands immobilises a circuit 6 visible underneath housings 22 of middle part 2. This FIG. 4 illustrates the free state of contactor 8, before it is placed under strain by closing back cover 3 of watch 100. In fact, elbows 89 and 189 are not yet touching the three bearing surfaces 21 of middle part 2, formed here by one surface of housings 2, which are oblong apertures. It is when back cover 3 is pressed and closed that contactor 8 is pushed towards these bearing surfaces and is placed under strain, definitively immobilising circuit 6 and forming the electrical contact thereof with accumulator 5.

The closing cooperation of back cover 3 with watch structure 100 is not detailed here. It may consist in screwing back cover 3 onto middle part 2 when they are independent, or onto plate 4 when they are in a single-piece, or onto another structure component of timepiece 100.

The invention also concerns a timepiece 100, in particular a watch, including at least one such structure 1.

What is claimed is:

1. A structure for a timepiece, said structure comprising:

a middle part; and a back cover for confining an electronic or electrical module, said module including a plate, the plate including a compartment that is arranged to receive an electrical energy accumulator, at least one circuit with at least one electrical contact area, and a connecting contactor to provide an electrical connection between said accumulator and said at least one contact area, said contactor being rigid and comprising an elastic return means tending to return said contactor to a rest geometry, said contactor including at least a first arm and at least a second arm together forming a clamp for pressing said circuit and said accumulator towards each other, wherein said back cover is arranged to bear, via at least a first bearing surface, on at least a first complementary bearing surface of said first arm of said contactor, said first arm is arranged to bear, via a first electrical contact surface on said accumulator positioned in said compartment, and wherein said back cover is further arranged to bear, via at least one second bearing surface, on at least one second complementary bearing surface of said first arm of said contactor, so as to press said accumulator onto said plate.

2. The structure according to claim 1, wherein said at least one first arm and said at least one second arm together forming a clamp for pressing said circuit and said accumulator towards each other on either side of said plate, each bearing on said plate.

3. The structure according to claim 1, wherein said middle part is arranged to bear, via at least a third bearing surface, on at least one third complementary bearing surface of said second arm of said contactor, said second arm is arranged to bear, via a fourth contact surface on said at least one contact area of said circuit so as to press said circuit onto said plate.

4. The structure according to claim 1, wherein said first arm forms a first elbow on said first electrical contact surface thereof, between said first complementary bearing surface and said second complementary bearing surface, so as to guarantee contact between said first electrical contact surface and said accumulator when said contactor is pushed towards said accumulator as a result of a pressure applied to said back cover towards said accumulator.

5. The structure according to claim 1, wherein said middle part is arranged to bear, via at least a third bearing surface, on at least one third complementary bearing surface comprised in one said second arm of said contactor, said second arm is arranged to bear, via a fourth contact surface on said at least one contact area of said circuit so as to press said circuit onto said plate and said contactor forms a second elbow between said second complementary bearing surface and said third complementary bearing surface, wherein said circuit is pressed against said plate on the opposite side relative to that of said compartment, and wherein said contactor forms a clamp tending to move said circuit closer to a said accumulator inserted into said compartment, said clamp arching onto said middle part under the action of a compressive force applied to said back cover to push said back cover towards said middle part.

6. The structure according to claim 1, wherein said middle part is arranged to bear, via at least a third bearing surface, on at least one third complementary bearing surface comprised in one said second arm of said contactor, said second arm is arranged to bear, via a fourth contact surface on said at least one contact area of said circuit so as to press said circuit onto said plate and said contactor forms a second elbow between said second complementary bearing surface and said third complementary bearing surface, wherein said circuit is pressed against said plate on the opposite side relative to that of said compartment, and wherein said contactor forms a clamp tending to move said circuit closer to a said accumulator inserted into said compartment, said clamp arching onto said middle part under the action of a compressive force applied to said back cover to push said back cover towards said plate.

7. Structure according to claim 6, wherein said back cover and said middle part form a single-piece assembly which is moveable relative to said plate.

8. The structure according to claim 1, wherein said contactor is a spring, which includes at least one transverse arm or a flat portion perpendicular to one said first arm and to one said second arm comprised therein in the same plane perpendicular to a contact surface of said accumulator, to prevent said contactor tipping under the effect of compressive force applied to said back cover towards said accumulator.

9. The structure according to claim 8, wherein said spring includes at least two substantially parallel strands connected by at least one transverse arm, each said strand comprising a free end with a transverse finger to make the removal of said spring from a housing of said middle part conditional on the application of a strain tending to move one of said two strands closer to or further away from the other.

10. A timepiece including at least one structure according to any of the preceding claims.

* * * * *